US005202738A

United States Patent [19]

Braswell et al.

[11] Patent Number: 5,202,738

[45] Date of Patent: Apr. 13, 1993

[54] HIGH-VOLUME DUPLICATOR SYSTEM AND METHOD PROVIDING EFFICIENT SYSTEM OPERATION IN THE COLLATED SIMPLEX LIMITLESS MODE

[75] Inventors: Charles D. Braswell, Henrietta; Riley L. Warddrip, Pittsford, both of N.Y.

[73] Assignee: Xerox Corporation, Stamford, Conn.

[21] Appl. No.: 744,103

[22] Filed: Aug. 13, 1991

[51] Int. Cl.[5] ..... G03G 21/00

[52] U.S. Cl. ..... 355/323; 271/288

[58] Field of Search ..... 355/323, 208, 206, 322; 271/288, 289

[56] References Cited

U.S. PATENT DOCUMENTS

| | | | |
|---|---|---|---|
| 3,395,913 | 8/1968 | Del Vecchio et al. | 271/64 |
| 3,830,590 | 8/1974 | Harris et al. | 355/323 |
| 3,870,295 | 3/1975 | Kukucka | 271/173 |
| 4,295,733 | 10/1981 | Janssen et al. | 355/323 |
| 4,358,197 | 11/1982 | Kukucka et al. | 355/323 X |
| 4,370,052 | 1/1983 | Murakami et al. | 355/323 |
| 4,411,515 | 10/1983 | Kukucka et al. | 355/321 |
| 4,530,593 | 7/1985 | Kasuya et al. | 355/323 |
| 4,961,092 | 10/1990 | Rab et al. | 355/323 |

*Primary Examiner*—A. T. Grimley
*Assistant Examiner*—Nestor R. Ramirez
*Attorney, Agent, or Firm*—Finnegan, Henderson, Farabow, Garrett & Dunner

[57] ABSTRACT

A copy system includes a duplicator and a sorter which has a plurality of multi-bin towers. Duplicator and sorter controls are provided for controlling the duplicator and tower transport devices and bin deflectors in the collated simplex mode. The size of each segment of an entered job is computed by the duplicator control as a function of available sorting means resources.

The duplicator control detects a single tower loading or multiple tower loading selection for limitless mode operation, and shuts down the duplicator and sorter after the completion of each job segment in the multiple tower loading mode, or after the completion of each job segment in the single tower loading mode if an empty tower is unavailable. The duplicator control restarts the duplicator and sorter in the single tower loading mode when an empty tower becomes available with the next segment size set to the number of bins in the empty tower and the destination of copies in the next job segment set to the empty tower, or in the multiple tower loading mode when the number of towers required for the next job segment are emptied and available with the start destination of copies in the next job segment set to the next previous start tower.

5 Claims, 15 Drawing Sheets

HIGH-VOLUME DUPLICATOR SYSTEM AND METHOD PROVIDING EFFICIENT SYSTEM OPERATION IN THE COLLATED SIMPLEX LIMITLESS MODE

CROSS-REFERENCE TO RELATED APPLICATIONS

Reference is made to the following related patent applications filed concurrently herewith and assigned to the present assignee:

Ser. No. (07/744,162) entitled HIGH-VOLUME DUPLICATOR SYSTEM AND METHOD PROVIDING EFFICIENT TOWER AND DUPLICATOR OPERATION AND FACILITATED UNLOADING IN THE COLLATED DUPLEX MODE by Charles D. Braswell, Robert E. Carley and Riley L. Warddrip.

Ser. No. (07/744,131) entitled HIGH-VOLUME DUPLICATOR PROVIDING EFFECTIVE SEPARATION OF COPY STACKS by Charles D. Braswell.

Ser. No. (07/744,104) entitled HIGH-VOLUME DUPLICATOR HAVING EFFICIENT OPERATION IN THE UNCOLLATED DUPLEX MODE by Charles D. Braswell.

BACKGROUND OF THE INVENTION

The present invention relates to high-volume reproduction systems and methods and more particularly to duplicator systems and methods structured for efficient operation in the simplex limitless mode.

There are a variety of commercial applications of reproduction technology where a need exists to reproduce manuals or books, or sets thereof, containing up to thousands of pages that are suitably assembled such as in three-ring binders or in bound units. A large number of book copies may be required for distribution to users or customers. Applications like these are called high-volume applications.

In particular high-volume applications, the books may have to be revised or updated periodically, such as every three or six months. In the revision process, some but normally not all pages will be modified and some pages may be deleted or added. In many cases, trade practices or regulatory requirements may make it necessary to reproduce the entire revised book or set of books as opposed to reproducing insert pages for appropriate placement in the original book copies. In any case, the page insert approach is typically undesirable because it is labor intensive and because of the likelihood of assembly errors.

The original text, graphics, and photographs, that constitute the book content, may reside in multiple sources. For example, an original may reside on microfilm, in electronic storage, on standard 8½"×11" paper, or on "paste-ups". Originals from which reproductions are to be made are derived from the multiple storage sources and placed on one or more selected media.

A typical commercial application in which high-volume reproduction technology is needed is that in which a manufacturer makes and sells relatively complex products for which maintenance books must be issued and revised from time to time. The production of maintenance books for a product which may be supplied in a variety of forms or models typically is relatively complex because of book differences that are required for different models and/or customers.

Offset lithography is one process that has often been used for high-volume reproduction, but it is typically relatively expensive. In this process, extensive setup time is required for building each master original or revised original. Relatively high pressman labor operating costs are incurred, and up to 10% of the total copy output constitutes waste copies caused by process adjustment during job startup and shutdown. It is noteworthy, however, that offset lithography does in general provide high resolution production of photographic originals.

Large output sorters, having multiple towers containing up to 600 or more bins, have been employed in offset lithography to support post-collation book production for high-volume jobs. However, the operation of such sorters and the lithography production process as a whole has been relatively inflexible especially in terms of accommodating more complex jobs that involve varying production requirements within a particular job or from job to job. Such inflexibility stems from the very nature of the whole lithographic reproduction and sorting process along with an absence of process controls that, if implementable at all, could otherwise facilitate the creation of added process flexibility.

In high-volume jobs that required "limitless" sorting, that is, a number of copies greater than the machine reproduction capacity, typically the operator of the lithography process must determine the job breakup and run the job parts accordingly. Another example of relative inflexibility in the offset lithography process is that in which some book copies may require certain pages to be different from corresponding pages in other book copies. While the lithography process may be operated to permit collation of the proper page copies in the various book copies, such process operation is highly inefficient, costly and inconvenient.

An additional example of flexibility limits in the offset lithography process is that in which a capability is needed for job parking at the end of work shifts. A job is parked when work is left in sorter bins at the end of a shift and the job is picked up again on the next shift, often the next day. The lithography pressman has limited system hardware support in resuming the parked job and completing it.

Pre-collation copying with use of a duplicator is another process that has been used for reproducing multiple copies of original manuals or books. However, the machine capacity limits successive segment sizes which therefore must be "hand-married" or manually collated after production. Copy integrity is also a problem in the pre-collation reproduction process. Thus, an occasional skewing of an original document on the platen glass requires inspection of all output copies to uncover any skewed ones and thereby assure copy product quality. Such inspection is impractical for high-volume jobs.

Another process that lends itself to high-volume reproduction is a process in which post-collation copying is performed with use of a duplicator and a high capacity sorter. Generally, the availability of electronic control with a duplicator provides a basic capability for creating process flexibility in high-volume reproduction jobs.

As compared to a pre-collation duplicator process, a post-collation duplicator process facilitates the performance of highly complex jobs because the layout of collation bins allows for the tailoring of some book copies to meet the requirements of particular customers or particular product models. Moreover, possible future commercial use of a common electronic format for source originals could be efficiently implemented in high-volume reproduction jobs with the use of electronically controlled duplicators.

High-volume, post-collation duplicators have been generally unavailable commercially because of a lack of required technology development.

More specifically, in a high-volume reproduction system, the sorter is structured with a plurality of multiple-bin towers which provide a high volume of bins for sorting. For example, the sorter may contain 10 towers having 60 bins each or a total of 600 or more bins with each bin having a capacity of 100 sheets.

Limitless sorting is a mode of duplicator operation in which the requested quantity of copies exceeds the sorter capacity. For example, with the duplicator operating in the collated mode, a total of 1000 copies may be requested for a set of 75 originals. The work product would thus consist of 1000 copy sets or books delivered to 1000 bins, respectively.

However, in this example, the sorter bin capacity is 600 and the job thus must be interrupted when the sorter has received as many job segments as the sorter can accept. The job can then be restarted, in the limitless mode, once one or more towers have been unloaded by the operator to provide sorter capacity for the next job segment or segments in the same job with the same 75 originals.

The 1000-copy job, as one example, could be partitioned into four 240-copy segments and one 40-copy segment. Once two segments are completed with eight towers occupied, the system would be shut down until tower unloading releases sorter capacity for resumption of the job.

In providing limitless sorting in a high-volume duplicator, consideration has to be given to various general modes in which the system may usually be operated. Thus, while limitless sorting is theoretically possible in the collated multiple-bin mode, operation in this mode involves copying of more than one set of originals which is not compatible with the inherent limitless-sorting process of multiple machine passes of the same set of originals. Multiple-bin operation is thus normally excluded from the limitless sorting mode.

In the duplex mode, the job segment size may be limited to the bin capacity of a single tower as explained in the aforementioned copending patent application Ser. No. 07/744,104. In that case, the duplicator system operates in the duplex mode one tower at a time.

Finally, with limitless sorting in the simplex, single-bin mode, it is desirable that the high-volume duplicator system be arranged to provide efficient and flexible operation. The present invention is directed to achieving this end.

SUMMARY OF THE INVENTION

The present invention has been made in view of the above circumstances and has as an object to provide a high-volume, post-collation copy engine or duplicator system in which system control is provided to coordinate and integrate duplicator and large capacity sorter operations for efficient, low cost and flexible operation of the reproduction process in the limitless, single-bin, simplex mode.

A further object of the present invention is to provide a high-volume copy engine or duplicator system in which each of multiple output copy stacks is efficiently delivered to multiple bins in at least two towers with stack separation being provided effectively to facilitate operator handling of the copy stacks.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims To achieve the objects and in accordance with the purpose of the invention, as embodied and broadly described herein, the copy system of this invention comprises means for duplicating successive original documents, means for sorting output copies delivered from the duplicating means, the sorting means including a plurality of towers each of which includes a plurality of bins, means for transporting output copies to each of the towers, means for directing output copies in each tower to each bin therein means for controlling the duplicating means and the tower transporting and bin directing means in the collated simplex mode, and the controlling means including: means for computing the size of each segment of an entered job as a function of available sorting means resources, means for operating the tower transporting means and the bin directing means to deliver successive copies in each job segment to assigned available bins, means for detecting a single tower loading or multiple tower loading selection for limitless mode operation, means for shutting down the duplicating and sorting means after the completion of each job segment in the multiple tower loading mode, or after the completion of each job segment in the single tower loading mode if an empty tower is unavailable, means for restarting the duplicating and sorting means in the single tower loading mode when an empty tower becomes available with the next segment size set to the number of bins in the empty tower and the destination of copies in the next job segment set to the empty tower, means for restarting the duplicating and sorting means in the multiple tower loading mode when the number of towers required for the next job segment are emptied and available with the start destination of copies in the next job segment set to the next previous start tower, and means for ending the job when the last job segment is completed.

BRIEF DESCRIPTION OF THE DRAWINGS

The accompanying drawings, which are incorporated in and constitute a part of this specification, illustrate one embodiment of the invention and together with the description provide an explanation of the objects, advantages and principles of the invention. In the drawings:

FIG. 5A1 portrays a functional block diagram of a control system for the duplicator of FIG. 2;

FIG. 5A2 shows a diagram of a programmed functional sequence employed in the duplicator control to start and stop sorter operation;

DESCRIPTION OF THE PREFERRED EMBODIMENT

Figure 1:
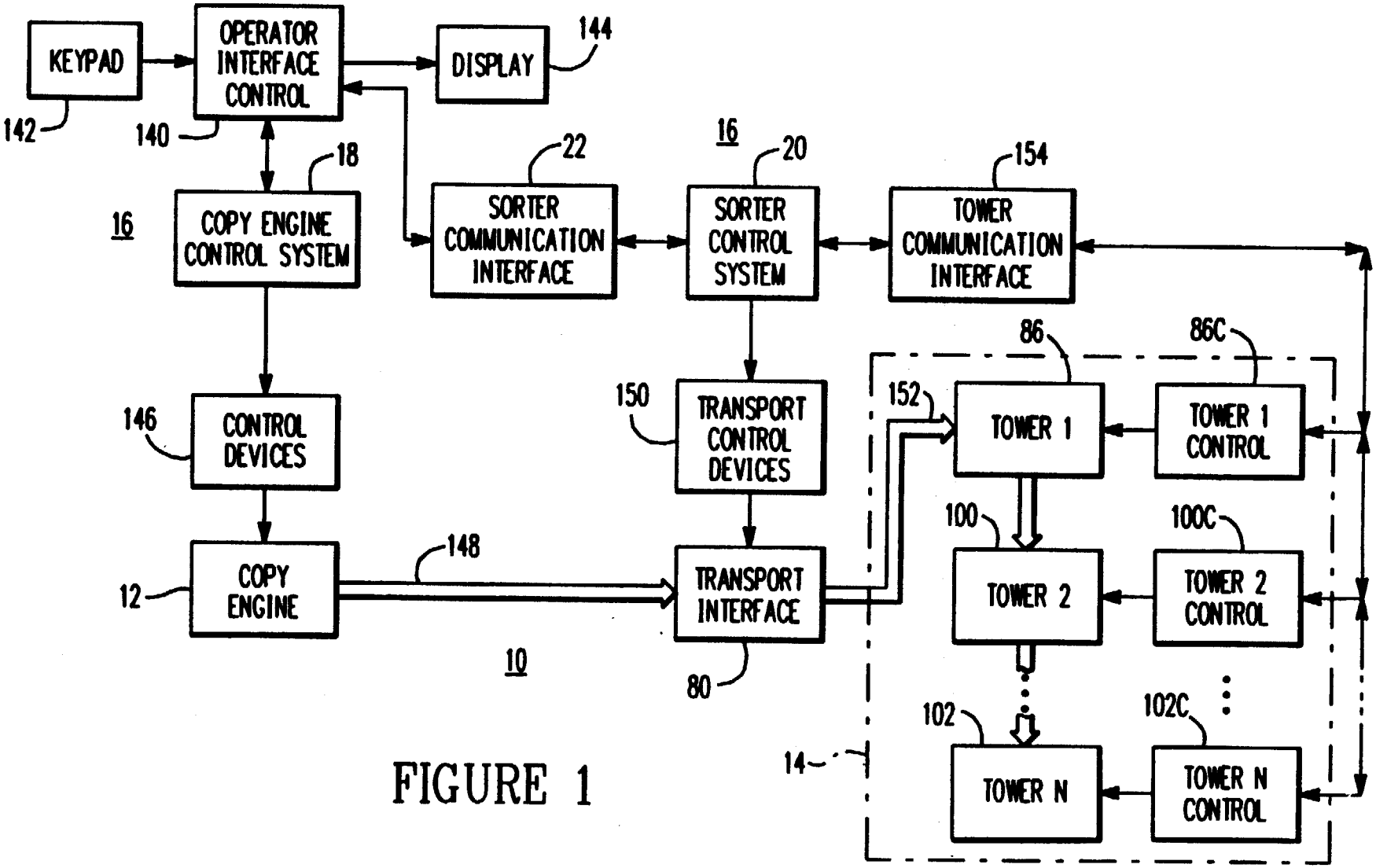
FIG. 1 is a block diagram of a copy system arranged in accordance with the principles of the present invention.

There is shown in FIG. 1 a copy system 10 having means for producing copies of original documents and means for sorting the copies for assembly into collated books or the like. The system 10 employs a copy engine 12 that in this preferred embodiment is in the form of a xerographic duplicator. Further, the system 10 employs a multi-tower sorter 14 that is coupled to the engine or duplicator 12 to receive copies as they are produced and direct them into tower bins as required for collated distribution assembly into books or manuals.

Generally, the copy system 10 is structured to meet the needs of customers who have high volume copying requirements. For example, in the commercial airline manufacturing industry, operation and maintenance manuals may contain thousands of pages and normally must be updated and reproduced frequently, such as every three months. An updated set of manuals may be issued to airline customers for each airliner in use.

The present invention is especially useful for application in copy systems designed for high copy-volume usage. In the preferred embodiment described herein, the copy system is provided in the form of a 9900/60+xerographic duplicator manufactured by the Xerox Corporation.

The copy system 10 further includes a control system 16 that is structured to operate and control the copy system 10 in accordance with the principles of the invention. The control system 16 includes an engine control 18 for the duplicator 12 and a sorter control 20 for the multi-tower sorter 14. A sorter communications interface 22 links the controls 18 and 20 to provide coordinated control and operation of the duplicator 12 and the sorter 14.

SYSTEM APPARATUS

In FIGS. 2-4B, duplicator apparatus 24 (corresponding to the duplicator 12) and sorter apparatus 26 (corresponding to the sorter 14) for the Xerox 9900/60+ unit are illustrated in greater detail and will be described herein to an extent that facilitates development of an understanding of the present invention.

Accordingly, the duplicator apparatus 24 employs an automatic document handler (ADH) 30 which automatically inverts and feeds an original document onto a platen glass 32 with proper registration against a registration edge. Original documents can also be placed manually on the platen glass.

Four xenon lamps 34 are flashed to illuminate the original document on the platen glass 32. In turn, mirrors 36 and 38 reflect an image of the original document through lenses 40 which transmit a focused image to the surface of a photoreceptor belt 42. Electric charge is applied to the belt 42 by a charge corotron 44.

Brighter areas of the reflected image discharge the underlying areas of the belt 42, while darker image areas of the belt 42 remain charged. Lamps 46 are employed to discharge the belt edge areas and the belt areas between copies to reduce dry ink consumption and to keep the duplicator 24 clean.

Five magnetic rollers 48 brush the belt 42 with a positively charged steel developer which carries negatively charge dry ink. Positively charged area of the belt 42 attract the negatively charged dry ink to form a dry ink image. A lamp and a corotron 50 loosen the dry ink image for transfer to copy paper.

Copy paper is obtained from one of three sources. Thus, a main tray 52 or an auxiliary tray 54 supplies paper for the copying process. A duplex tray 56 refeeds paper with first-side image for second-side imaging in a duplex mode in which two-sided copies are produced.

The dry ink image is transferred to a sheet of copy paper after the paper is transported over belt 58 and as it passes between a bias transfer roller/transfer corotron 60 and the photoreceptor belt 42. A detack corotron 62 (not shown) strips the paper from the belt 42 after image transfer. The copy paper next passes through a roller section 66 where a pressure roller applies pressure to the paper and a heat roller melts the dry ink into the copy paper.

A lamp, corotron, and brush 64 clean the photoreceptor belt 42 for the next copy.

When the copy paper reaches a turnaround station 68 in the simplex mode, the paper is transported over path 70 for delivery to the sorter 26. In the first pass in the duplex mode, the paper is inverted into the station 68 and then is returned over path 72 to the duplex tray 56 for a second pass in which the second paper side is imprinted with the second side image. After the second pass in the duplex mode, the paper is sent from the station 68 over the path 70 to the sorter 26.

A xerographic maintenance module 74 is used by the operator or a service representative to adjust xerographic voltages and currents to specifications.

Figure 3:
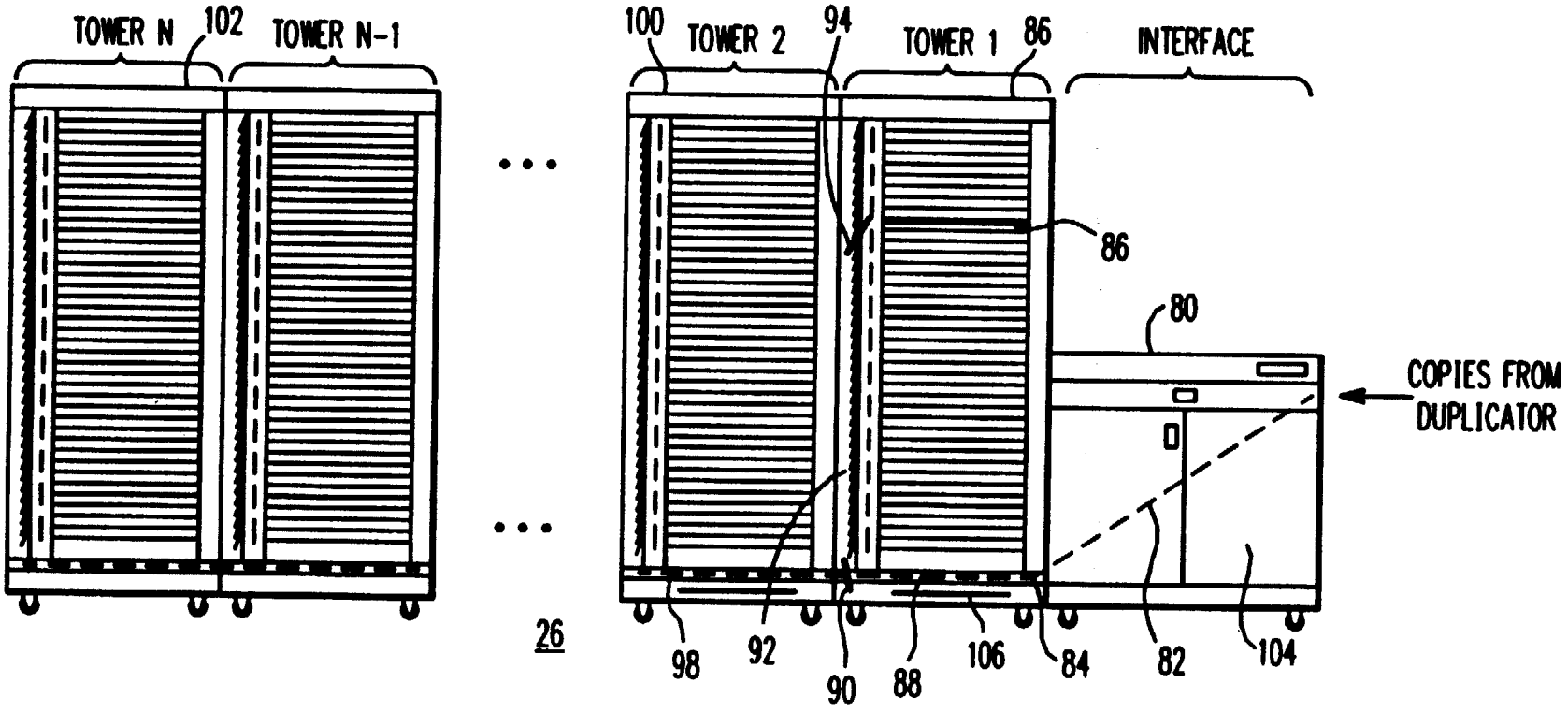
FIG. 3 is an elevational view of a sorter included in the copy system of FIG. 1.

As shown in FIG. 3, copy sheets are delivered the sorter paper path from the duplicator 24 to an interface module 80 between the duplicator 24 and the sorter 26. In the module 80, sheets proceed down an incline transport 82 to an entry level 84 for a first sorter tower 86.

Figure 4A:
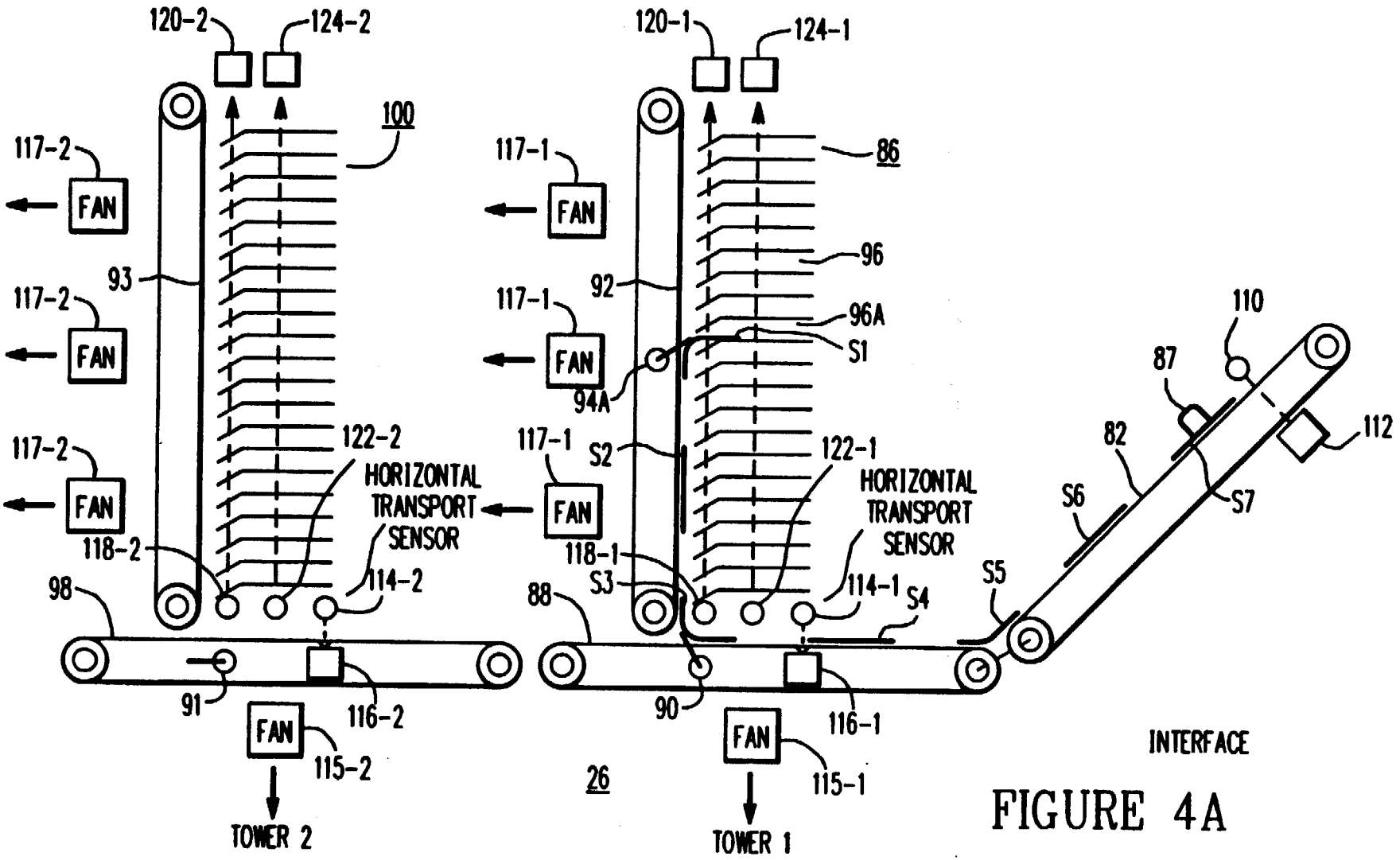
FIG. 4A shows an enlarged, generally schematic view of towers in the sorter of FIG. 3 along with interface apparatus connected between the duplicator and the sorter.
Figure 4B:
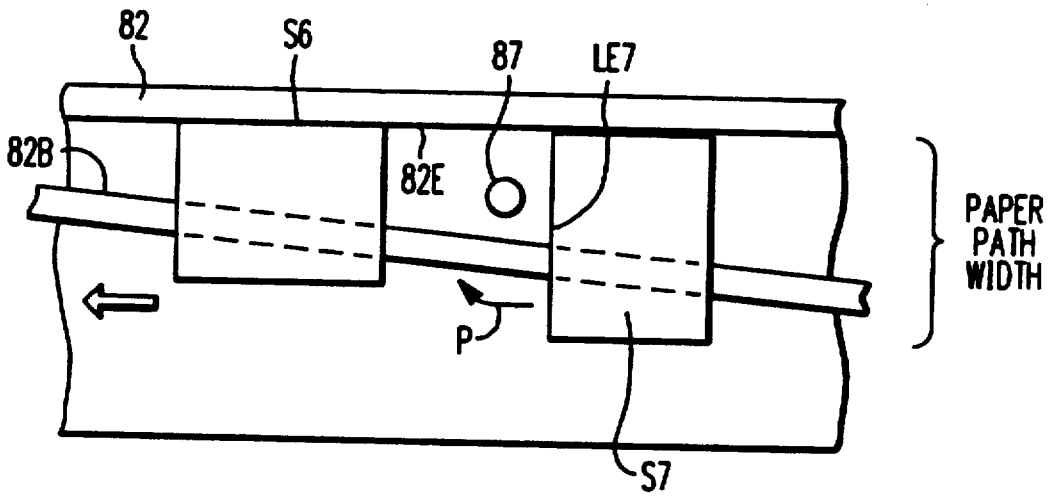
FIG. 4B is a partial top plan view of an incline transport employed in the interface apparatus of FIG. 4A.

As indicated in FIGS. 4A and 4B, a pivoting force P is applied to each copy sheet just after entry to the incline 82 by rotator means such as a spinner device 87. The spinner 87 is mounted (FIG. 4A) inboard of the paper path and off-center in relation to a leading short dimension edge LE7 of sheet 57 and projects upwardly (FIG. 4B) beyond the plane of an incline ball-on-belt system 82B thereby acting as an obstacle to the sheet S7 and imposing the pivoting force P against the leading LE7 of the sheet S7.

The sheet S7 thus pivots in its plane so that the short leading sheet edge LE7 moves toward alignment with a metallic registration edge 82E along the length of the incline. The ball-on-belt system 82B is skewed toward the registration edge 82E thereby quickly directing the pivoting sheet S7 into registration with the registration edge 82E as the sheet S7 continues downwardly inclined movement on the incline transport 82. The weight of distributed balls (not shown) holds the sheet against an underlying skewed belt (not shown) thereby providing added continuing registration force on the sheet S7. Sheet S6 is ahead of the sheet S7 and is shown as having its short leading edge LE6 registered against the incline edge 82E and thus properly oriented for entry to the sorter 14.

A horizontal transport 88 delivers each sheet to a vertical deflector gate 90 which, if actuated, deflects the sheet to a vertical transport 92 for upward travel in the first tower 86. When the sheet encounters an actuated bin deflector 94A, the sheet is deflected horizontally into the associated bin 96.

If the vertical deflector gate 90 is deactuated when a sheet reaches it, the sheet continues over a horizontal transport 98 in a second tower 100 and like horizontal transports in each successive tower until a tower with an actuated vertical deflector gate like the gate 90 is encountered. The sheet is then deflected upwardly in that tower for routing to the selected bin. An overflow catch tray (not shown) is provided at the output of an Nth tower 102 if no vertical deflector gate in any of the sorter towers is actuated.

In FIG. 4A, the first two towers 86 and 100 of the sorter 26 are shown in somewhat greater detail. The interface incline transport 82 includes an interface paper path sensor preferably in the form of an optical pair that includes an LED device 110 and an optical sensor 112. Paper sheets such as the sheets S6 and S7 are held, as previously described, against the incline belt surface and properly oriented by the bell-on-belt system 82B.

As a sheet such as sheet S5 is transferred to the horizontal belt system 88 for the first tower 86, it is held against the horizontal belt surface in proper position by a pressure differential produced across the horizontal belt by fan means 115-1. Another paper sensor preferably in the form of an optical pair 114- 1 and 116-1 operates as a horizontal paper transport sensor in the tower 86.

When a sheet such as sheet S3 reaches the vertical deflector 90 in its actuated position, the sheet S3 is deflected upwardly in the first tower 86 and transferred to the vertical belt system 93. A sheet such as sheet S2 is held in proper position against the vertical belt surface by a pressure differential produced across the vertical belt by fan means 117-1 three fans in the preferred embodiment.

The vertical transport belt 92 drives each sheet upwardly until an actuated bin deflector such as deflector 94A is encountered. The sheet such as sheet S1 is then directed into the associated bin, i.e. bin 96A.

An optical pair sensor 118-1, 120-1 is employed in the tower 86 to detect paper entry into a bin. Another optical pair 122-1, 124-1 generates a signal when the tower 86 is empty.

Other towers in the sorter 26 include optical sensor pairs, deflectors, transport belts, and fans like those described for the tower 86. A vertical deflector 91 in the second tower 100 is shown in the unactuated position. Other elements like those in the first tower 86 are designated by reference characters corresponding to the reference characters used for the same elements in the first tower 86.

When a copy job is started, sorting system status data is sent to the copy engine control system 18 (FIG. 1) specifics of how sorting is to be done, in terms of bin sequencing, tower selection and operating mode, are established in the copy engine of duplicating control system 18. The specifics including job parameters, sorter start and stop commands, and handling instructions for delivered copies, are communicated to the sorter control system 20.

In the preferred embodiment, the sorter control 20 is located on a system control board in the interface module 80 as indicated by the reference character 104. A common cable (not shown) connects the system control board 104 to a tower logic board in each tower. Only one tower logic board 106 is shown in FIG. 3. As more fully explained subsequently herein in the general and detailed description of the control system 16, the sorter, and tower controls monitor and operate electrical devices in the towers to achieve sorter and copy system performance in accordance with the present invention.

In implementing the present invention in the preferred embodiment, the following information is sent from the copy engine or duplicator control 18 to the sorter control 20:

Command: "Sorter Run"
  Instructs the sorting system to turn on drive systems as required.

Command: "Sorter Stop"
  Instructs the sorting system to turn off all drive systems.

Data "Specify Job"
  Describes all attributes of the job to the sorting system

Command: "Initialize Sequence"
  Instructs the sorting system to start at the first bin the job will use.

Sorter status data includes number of towers, identity of any offline towers, available bins, and empty status of each bin. The duplicator control system 18 includes job segment size and other job parameters from sorter status data and job options selected by the operator.

Command: "Request Available Towers and Bins"
  Asks the sorting system to send a message that indicates what resources are available.

Command: "Request Required Towers and Bins for Distribution Job"
  Asks the sorting system to send a message that indicates resources required for Distribution job.

The following information is preferably sent from the sorter control 20 to the copy engine or duplicator control 18:

Data: "Towers and Bins Available"
  Describes what tower and bin resources are available, indicates empty and offline status.

Data: "Required Towers and Bins for Distribution Job"
Describes what tower and bin resources are required for a Distribution Job.
Data: "Copy Sorted"
Indicates that a copy has entered a bin, used for job integrity control
Data: "Sorting System Jam"
Indicates that a jam has occurred in the sorting system.
Data: "Sorting Jam Cleared"
Indicates that the current jam has been cleared.
Data "Sorter Empty Status"
Indicates which towers are empty and which are not.

OVERVIEW OF COPY SYSTEM CONTROL

With reference again to the copy control system 16 in FIG. 1, an operator interface control 140 is provided for the copy engine or duplicator control system 18. A keypad 142 enables an operator to enter job setup and other data. Job status and other data are shown on a display 144.

Figures 1, 5A:
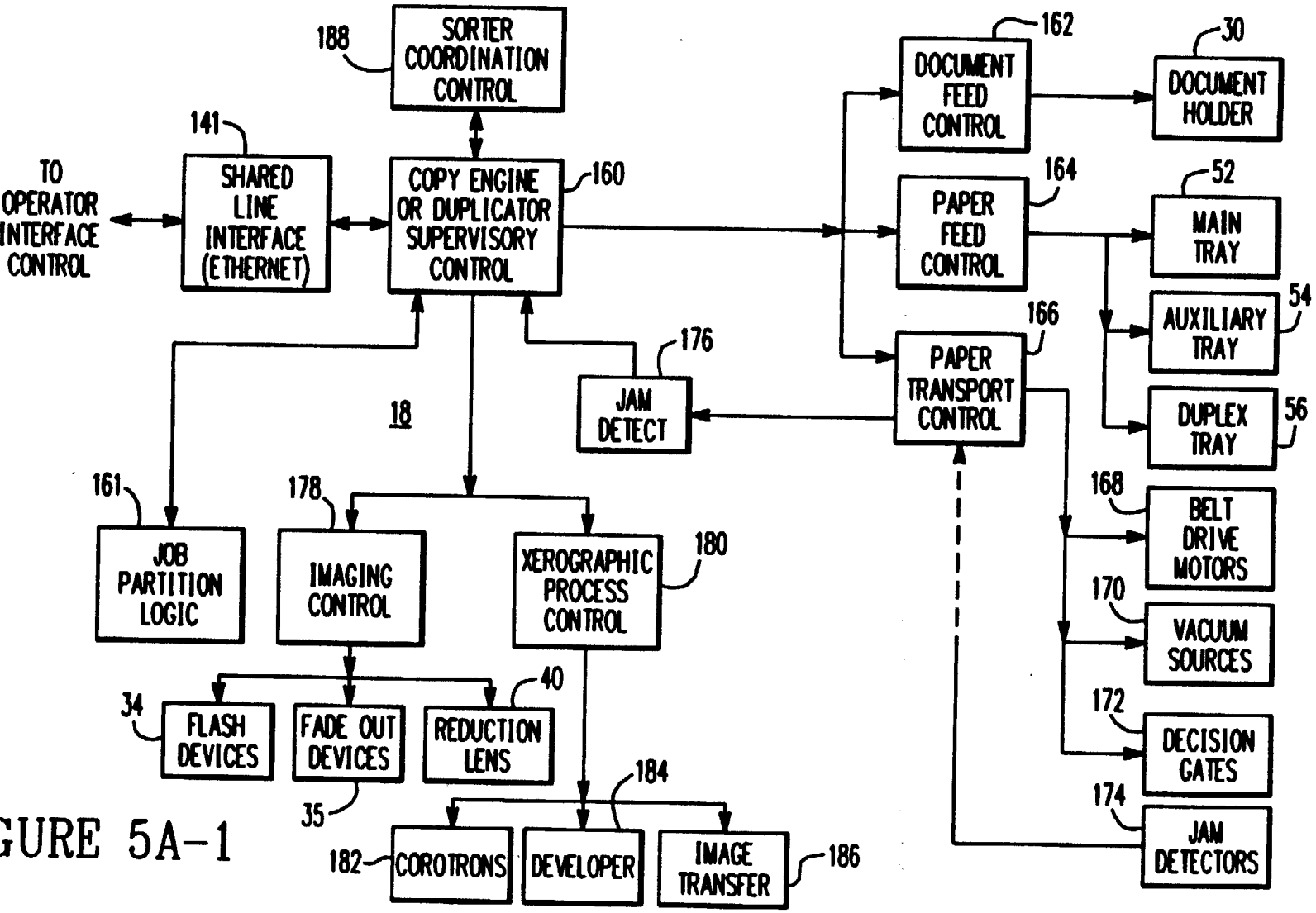
Figure 5B:
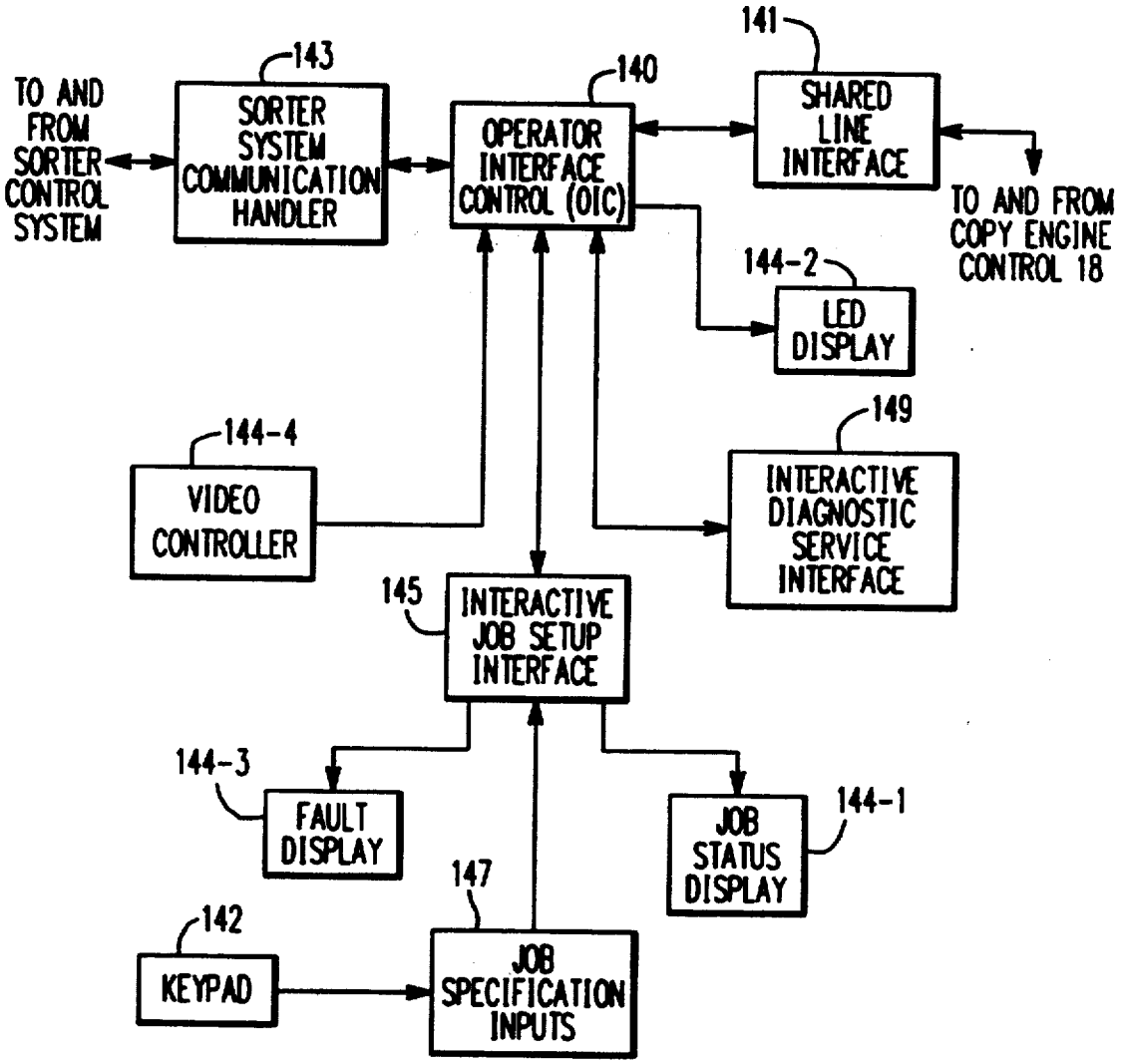
FIG. 5B is a more detailed functional block diagram for an operator interface control employed in the duplicator control of FIG. 5A1.

The operator interface control (OIC) 140 is illustrated in greater detail in FIG. 5B. An OIC screen includes display 144-1 which shows the status of a running job and display 144-3 which shows any faults that occur during the running mode. A video controller 144-4 controls the writing of information on the OIC screen. LED display 144-2 shows the copy quantity and other data.

In the operating mode, interactive job setup software 145 is provided as part of the OIC 140 to process job specification inputs 147 entered by the operator through the keypad 142. A sorter system communication handler 143 handles command and data transmissions to and from the sorter control system 20 after a job setup is completed and the job is started. When the copy system 10 is placed in a diagnostic mode, interactive diagnostic service software 149 is provided to process diagnostic inputs entered by a technical representative in the process of running diagnostics on the system.

Job selection parameters entered by the operator are processed by the OIC 140 for use during software execution in the control and coordination of the copying and sorting processes. Job selection parameters include:

Copy Quantity
Mode—1 side to 1 side, 1 side to 2 sides, 2 sides to 1 side, 2 sides to 2 sides
Output—top tray, uncollated sorter, collated sorter, collated supplement, special distribution
Starting Bin
Starting Tower
Number of Bins Per Set
Capacity of Bins—collated mode
Capacity of Bins—uncollated mode
Bin Skip Mode
Towers in Limitless Sorting After First Pass—single, multiple Once a copy job has been entered into the copy system 10 and original documents are placed in the original document holder 30 (FIG. 2), the copy engine or duplicator control 18 (FIG. 1) operates the copy engine 12 or duplicator 24 (FIG. 2) through control devices 146 and executes the programmed job. The sorter control 20 is coordinated to operate the sorter 14 in accordance with the job requirements and in accordance with the present invention as more fully described hereinafter.

Sorter coordination is achieved through the transmission of commands and data from the duplicator control 18 through the OIC 140 and sorter communication interface 22 to the sorter control 20. Data is also sent from the sorter control 20 through the sorter communication interface 22 and the OIC 140 to the duplicator control 18 to facilitate coordinated system operation. The transmitted commands and data are preferably those described previously herein for the preferred embodiment.

As indicated by reference character 148 (FIG. 1), copy sheets are transported from the duplicator output to the transport interface 80 which is operated by control devices 150 under the control of the sorter control system 20. The copy sheets are then transported to the towers 86, 100, 102, etc. as indicated by reference character 152 and as described in connection with FIG. 3.

A tower control 86C, 100C, 102C, etc. is provided for each tower in the sorter 14. In the Xerox 9900/60+ duplicator, the sorter 14 can include up to 10 towers with each tower having sixty bins.

The sorter control 20, under duplicator control commands, operates through a tower communications interface 154 to direct the tower controls in operating the towers in accordance with the present invention and in accordance with system and programmed job requirements.

Each of the controls at the various control levels preferably includes a programmable microcomputer (not specifically shown). In the present embodiment, for example, each of the various controls preferably includes a microprocessor chip as follows:

duplicator control 18—Intel 8085
OIC 140—Intel 8085
sorter control 20—Intel 8088
each tower control—Intel 8051

COPY ENGINE OR DUPLICATOR CONTROL SYSTEM

Figure 2:
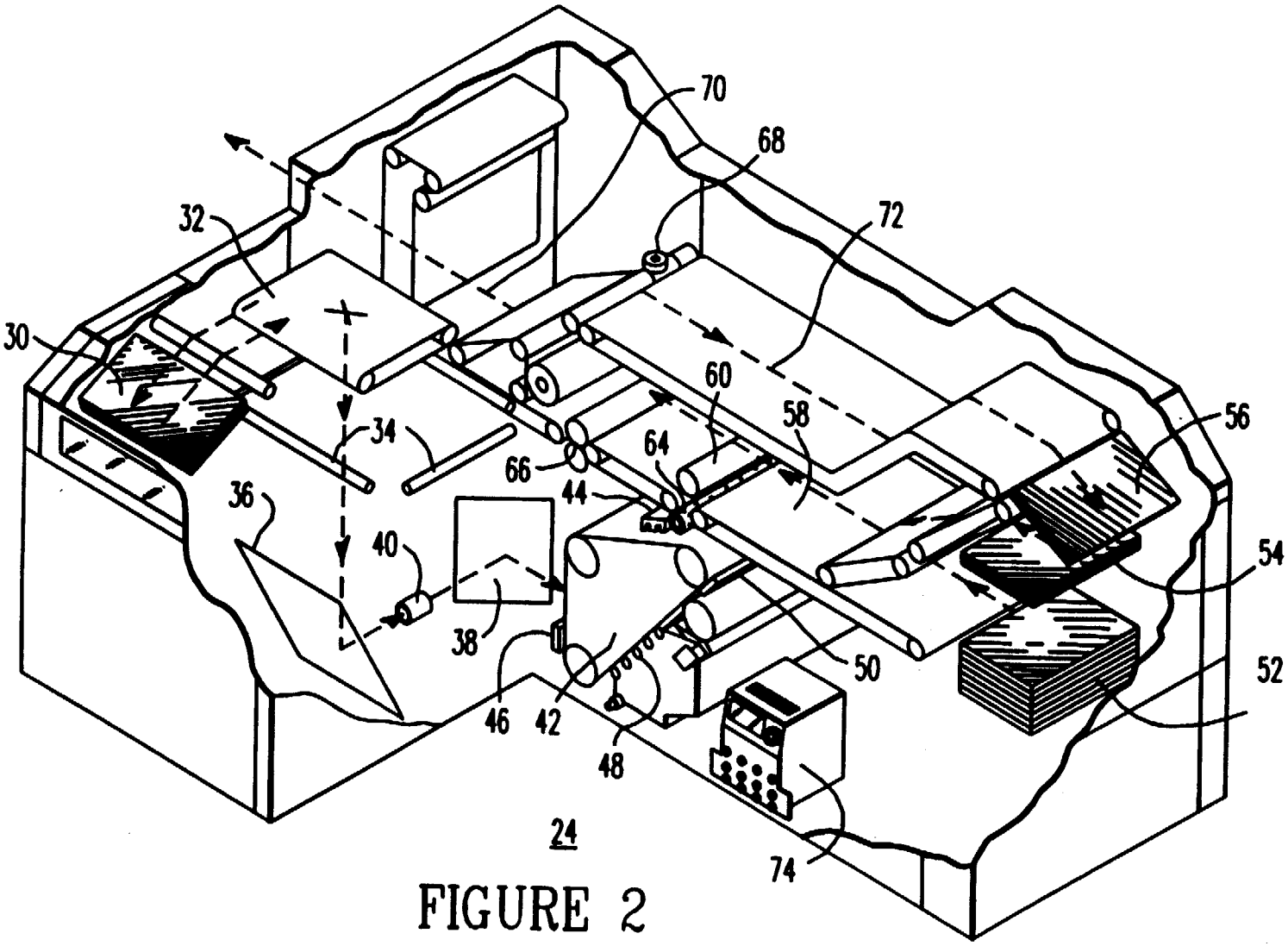
FIG. 2 shows a perspective view of a copy engine or duplicator that is included in the copy system of FIG. 1 and that is partially broken away to show how copies are produced from original documents.

The duplicator control 18 is shown in greater detail in FIG. 5A-1. Generally, the duplicator control 18 directs and coordinates the operation of the duplicator 24 through basic control functions including document and copy paper feed and transport control, image generation control, and image transfer and fusing control (xerographic process control). Various control devices, described in connection with the duplicator apparatus 24 of FIG. 2, are operated under sequencing and logic control by the duplicator control 18 in executing these basic control functions.

Input data defining the current copy job is transferred through the shared line (ethernet) interface 141 to a supervisory control level 160 of the duplicator control 18 from the operator interface control 140. Where a programmed job exceeds the system resources programmed job partition logic is employed by the duplicator control 18 to divide the job into sub-jobs which individually are appropriate to the system resources and which taken together constitute the programmed job. Job factors considered in the partitioning logic include: copy quantity, copy mode (simplex, duplex, etc.), duplex tray capacity, and sorting capacity.

A document feed control 162 operates a document belt drive and other document feed devices to transfer original documents sequentially from the original document holder 30 to the platen glass as successive copy operations are completed. A copy paper feed control 164 similarly operates paper feed devices associated with the operator selected tray 52, 54 or 56.

As successive copy sheets are fed to the copying process, a paper transport control 166 operates various belt motors 168, vacuum sources 170 and decision gates 172 along the paper path as required to execute each copying operation within the duplicator machine 24. Strategically located jam detectors 174 signal the paper transport control 166 if a paper jam occurs. The supervisory control 160 is also signaled as indicated by reference character 176 and then initiates appropriate action.

An imaging control 178 controls the flash units 34, fade out devices 35 and the reduction lens 40 in producing an image on the photoreceptor belt 42. A xerographic process control 180 operates various corotrons 182, developer apparatus 184, and image transfer devices 186.

A sorter coordination control 188 generates SORTER RUN and SORTER STOP commands as inputs to the sorter communications interface 22 in step with the start and end of copy sheet output from the duplicator 24. The sorter coordinator 188 also collects data that describes all attributes of the current job and transmits such data to the sorter control 20. The sorter coordinator 188 further initializes the sorter control 20 to start at the first bin that will be used by the job.

As shown in FIG. 5A-2, a SORTER RUN command 189 is generated in response to entry of a START PRINT signal 191 by the operator or when a NEXT DUPLEX BATCH READY logic signal 193 is generated after a previous duplex batch has been completed by the sorter 14. A STOP command 195 results when the present duplex batch is completed by the sorter 14 as indicated by block 197.

SORTER CONTROL SYSTEM

The sorter control 20 transmits data on towers and bins availability and requirements in response to command requests from the sorter coordinator 188. As listed previously herein, other data transmitted to the sorter coordinator from the sorter control 20 includes jam data, sorter status and copy sorted.

Sorter data is received by the OIC 140 and processed into a data base of sorter status information. The sorter data base is used by the duplicator control system 16 in the execution of control software that controls and coordinates the copying an sorting processes.

The sorter control 20 and associated tower controls are shown in greater detail in FIGS. 6A–6B and 7A–7C. In addition to inputs from the sorter communications interface 22, inputs 190 are applied from a keypad and the interface downramp entry sensor 110, 112 (FIG. 4) to the sorter control 20. An interface control display 193 displays running job data such as the tower bin scheduled to receive the next copy and the number of copies in that bin. In the diagnostic mode, keypad entries are made and the display 193 generates information that results during operation of the interactive diagnostic process.

An interface transport control 194 provides on/off control for the interface transport 82 through a downramp drive motor 196 as a function of signals from the downramp entry sensor 110, 112. Diagnostic logic 198 is employed by the operator or service person to test sorter operation and to resolve fault conditions.

Figure 6A:
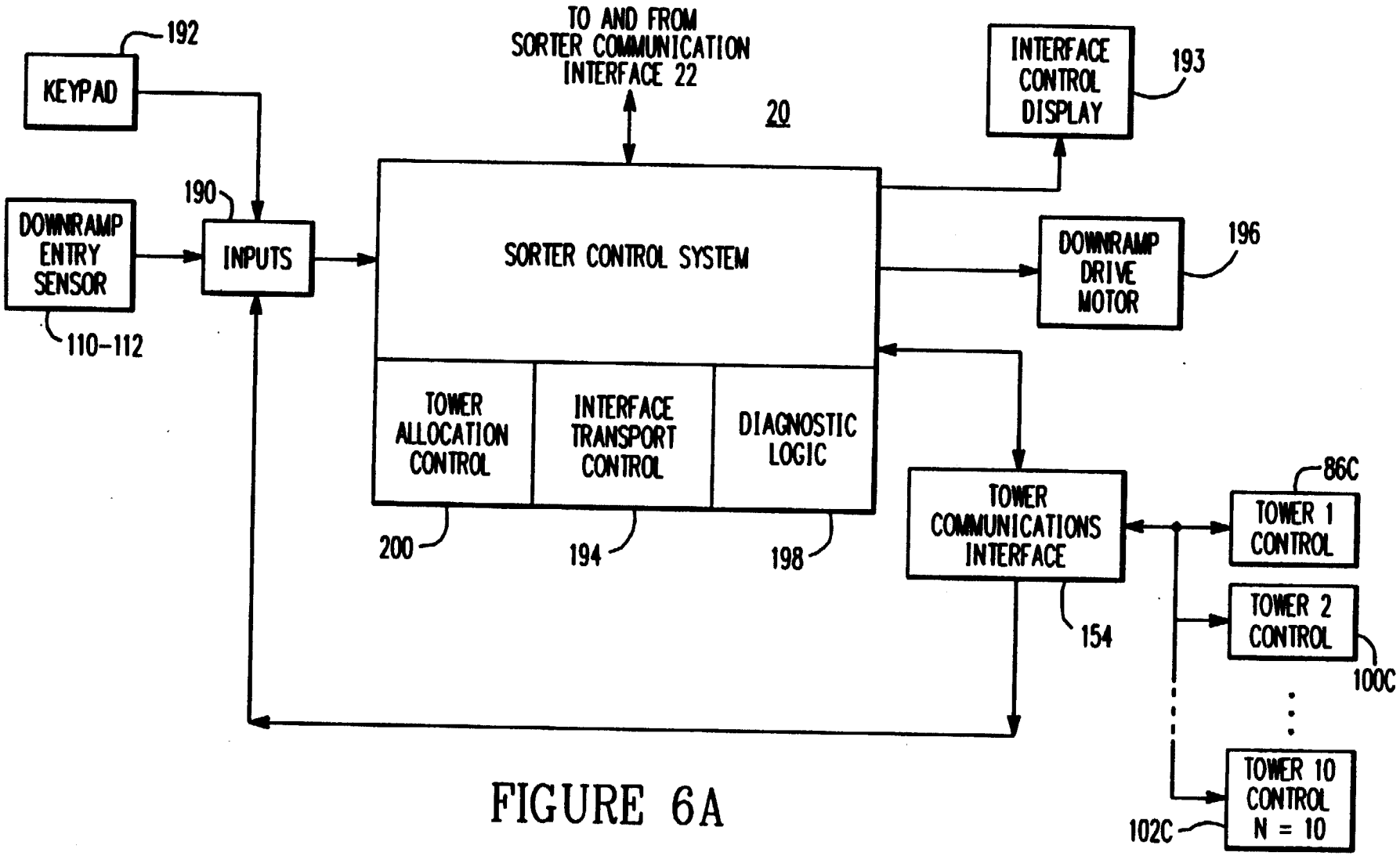
FIG. 6A shows a functional block diagram of a control system for the sorter of FIG. 3.
Figures 2, 5A:
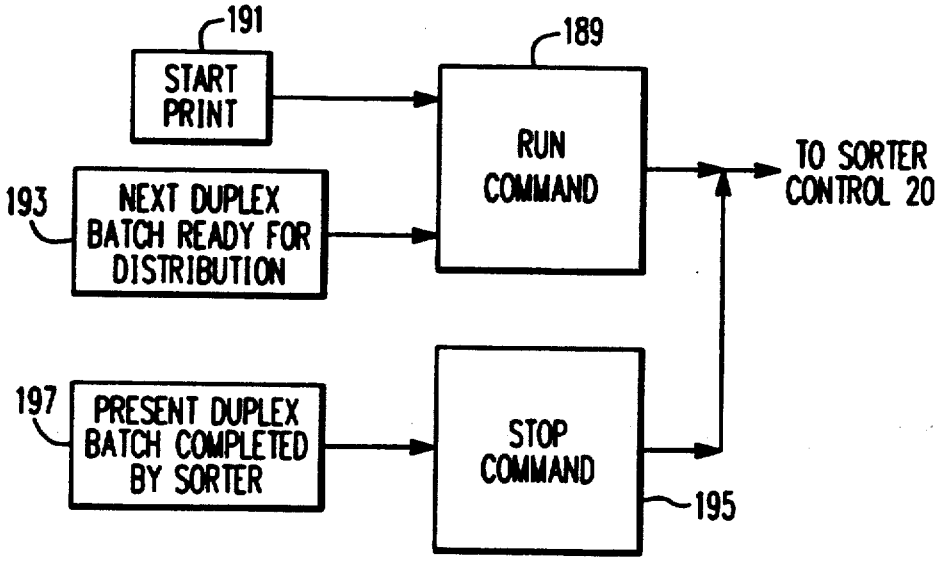
Figure 6B:
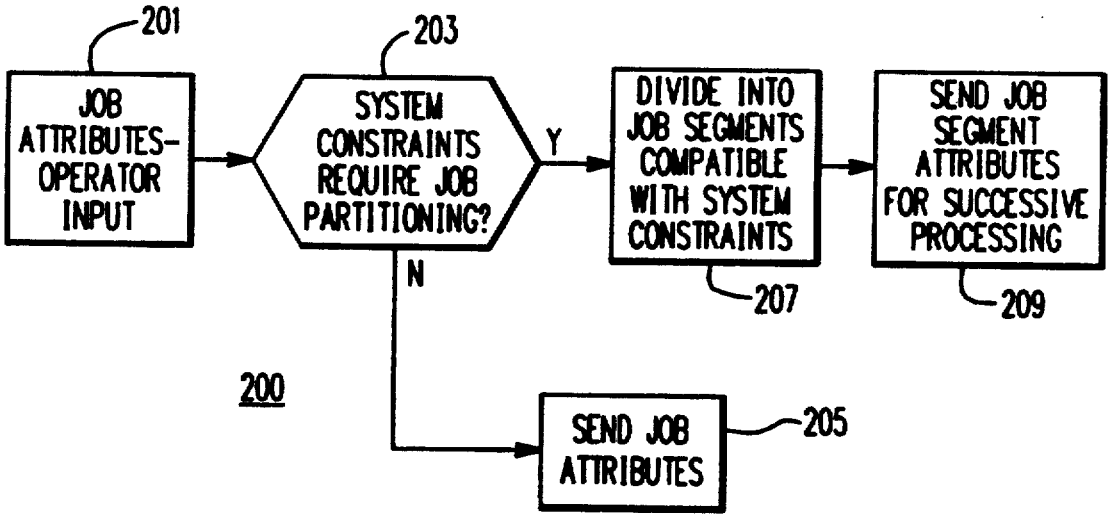
FIG. 6B is a functional block diagram representing programmed processing of copy job attributes in the duplicator and sorter control systems.

A tower allocation logic control 200 is employed by the sorter control 20 to modify commands from the duplicator control 18 and develop respective tower commands that specify requirements for coordinated operation of the towers in distributing output copies from the duplicator 24 and completing the current job. As shown in FIG. 6B, the logic control processes job attributes 201 that have been input by the operator and determines in test block 203 whether system constraints require the specified job to be divided into sub-jobs. If not, block 205 transmits the job attributes for tower processing.

If partitioning is required, block 205 divides the job into job segments each of which is compatible with system constraints. The attributes for the computed job segments are sent to the tower controls one-by-one until the job segments are successively completed, at which time the whole job as specified by the operator is completed.

Tower commands are transmitted to the respective tower controls 86C, 100C, 102C, etc. through the tower communications interface 154. As a specific example, the Nth tower control in FIG. 6A is designated as the tenth tower control which corresponds to the maximum number (10) of towers that the Xerox 9900/60+ can currently accommodate. Tower controls 3 through 9 are not shown in FIG. 6 since they are like the illustrated tower controls.

Figure 7A:
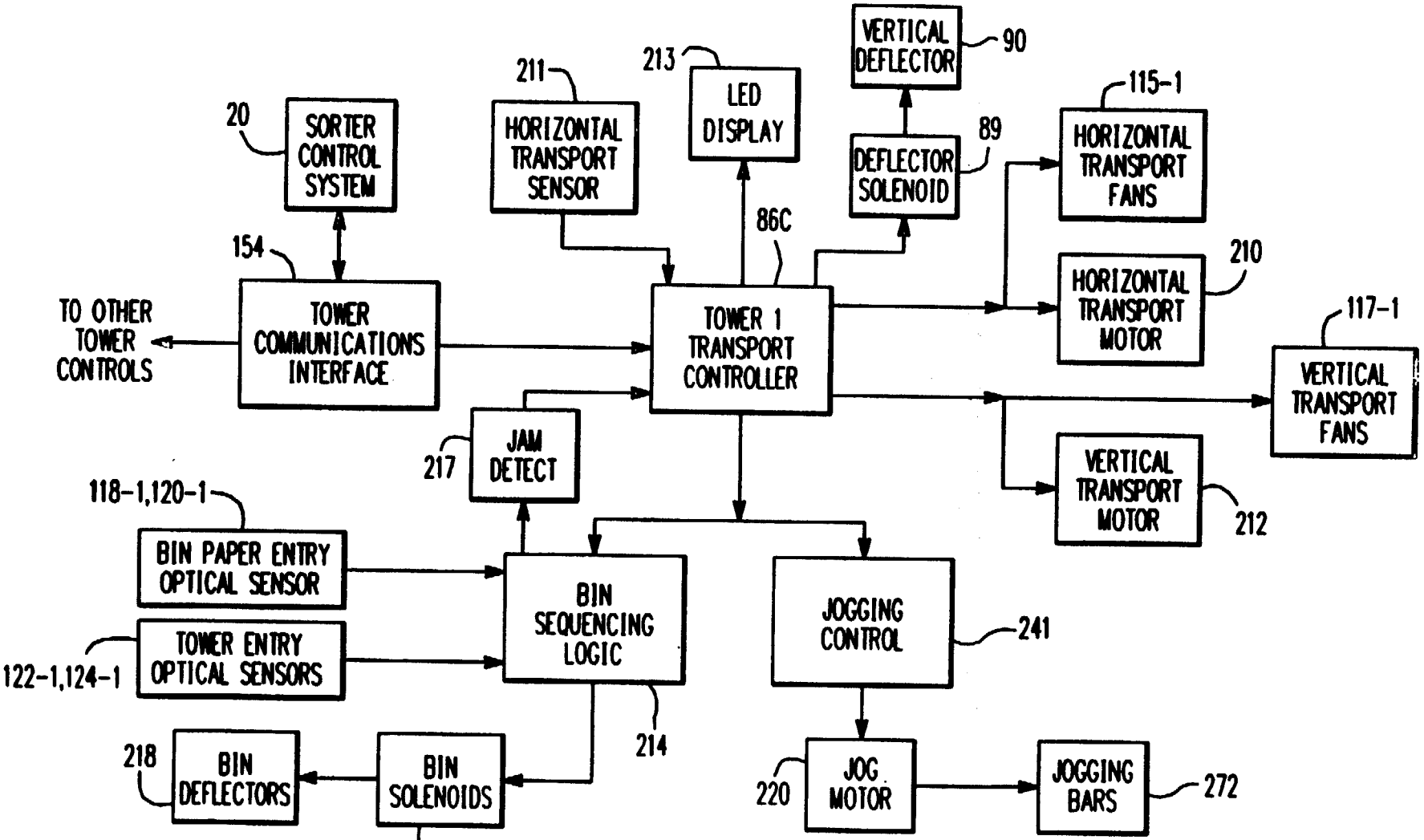
FIG. 7A shows a functional block diagram of a control system that is provided for each tower in the sorter.

More detail is shown for the tower control 86C in FIG. 7A. Other tower controls have like detailed structural content.

Commands for the tower control 86C from the sorter control 20 specify tower start/stop, tower sequencing based on copies to be delivered to each bin. It is also preferred that a START signal for the horizontal transport for the next available tower, such as the tower 100, be sent to the control for that tower so that it is ready in the event paper flow is diverted from the tower 86.

Figure 7B:
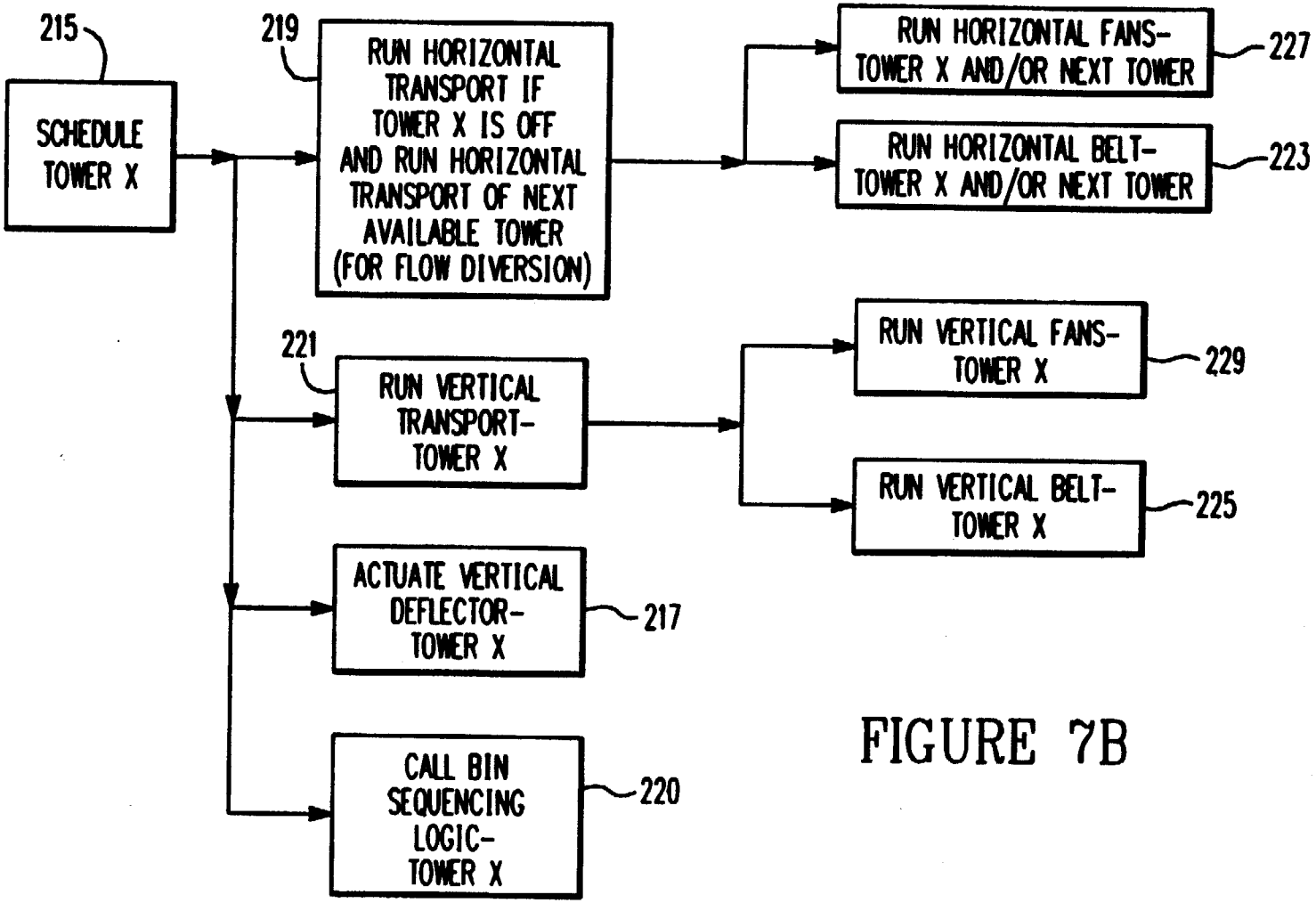
FIG. 7B illustrates programming employed in the tower control to operate the tower mechanical devices.

Reference is now made to FIG. 7B as well as FIG. 7A. If a tower X, such as the tower 86, is to receive copies as indicated by block 215, block 217 actuates a solenoid 89 to operate the associated vertical deflector 90. Blocks 219 and 221 start the associated horizontal and vertical belt motors 210 and 212 under direction from blocks 223 and 225 and the single horizontal fan 115-1 and the three vertical fans 117-1 are started under direction from blocks 227 and 229. In addition, the horizontal transport for the next available tower is started by the block 223 as previously indicated.

After the bin sequence for the tower 86 is completed, the vertical transport 92 (FIG. 4) is turned off and the associated vertical deflector is deactuated. Since subsequent sheets are to pass through the tower 86 to the next available tower such as the tower 100, the horizontal belt motor 210 for the horizontal transport 88 and the horizontal fan 114-1 are kept running. A horizontal transport sensor signals the horizontal transport status to the tower control 86C. LED displays 213 indicate when the tower is empty and when a paper jam has occurred in its operation.

The bin sequence is controlled by bin sequencing logic 214 which actuates bin solenoids 216 to operate bin deflectors for successive bins in accordance with the scheduled bin sequence. Copy sheets transmitted in a copy sheet stream from the duplicator 24 are thereby distributed in the sorter 14 in accordance with commands and attributes received from the sorter control system 20 with feedback regulation provided by signals from the bin entry sensors 118-1, 120-1.

Additional bin status data is supplied to the bin sequencing logic 214 by the tower empty sensor 122-1, 124-1. Such data is provided for LED display and transmitted to the duplicator OIC 140 for its status data base.

Any jam detected by jam detection logic 217 on the basis of feedback signals from bin and tower entry sensors is transmitted to the tower control 86C for appropriate action, such as a sorter shutdown followed by a job redefinition for restart after the jam is cleared.

Figure 7C:
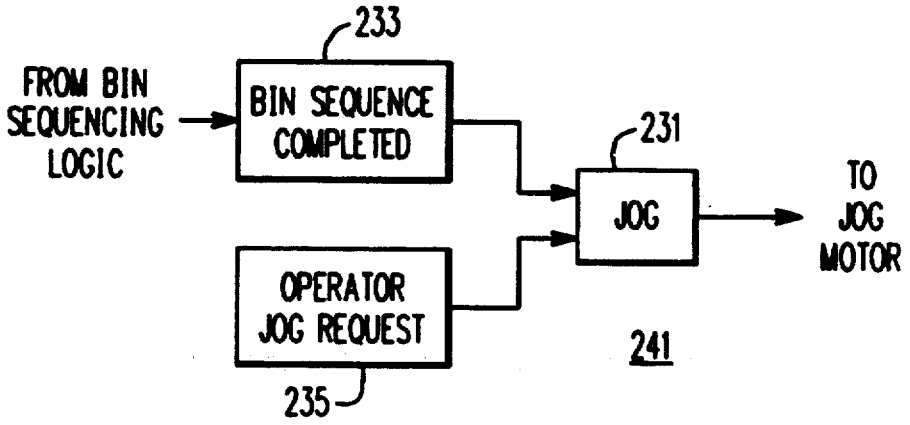
FIG. 7C shows program logic employed to control paper jogging bars in the towers.
Figure 7D:
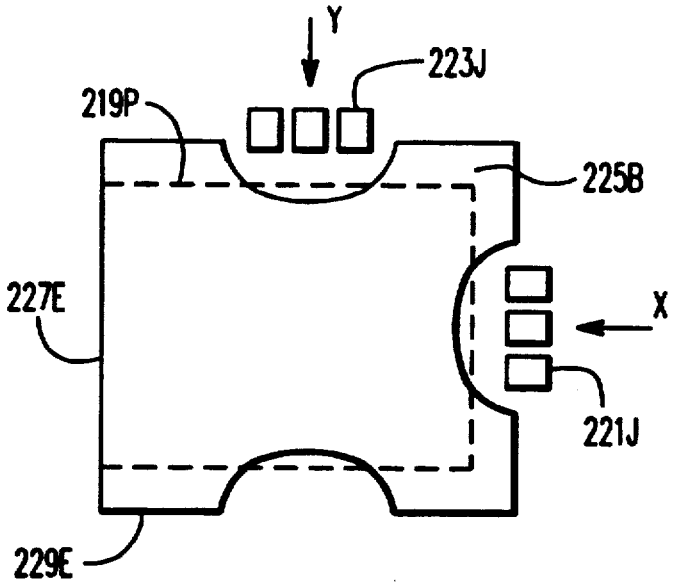
FIG. 7D is a schematic top plan view of the base of a tower bin along with jogging bars employed to push paper copies into an aligned stack within the bin.

A jogging control 241 operates a tower jog motor 220 to drive jog bars 221J and 223J (FIG. 7D) along X and Y axes to shuffle sheets into alignment in each bin in a tower such as the tower 86. A sheet of paper 219P delivered to a bin and located on bin base 225B is pushed against bin edges 227E and 229E by the jog bars 221J and 223J and thus aligned with previously jogged underlying sheets. As shown in FIG. 7C, such jogging is programmed in block 231 to occur when block 233 indicates completion of the bin sequence for the tower or when block 235 signals an operator initiated jog, and when copies are being distributed to another tower.

COPY SYSTEM OPERATION IN THE COLLATED, LIMITLESS, SIMPLEX MODE

Figure 8A:
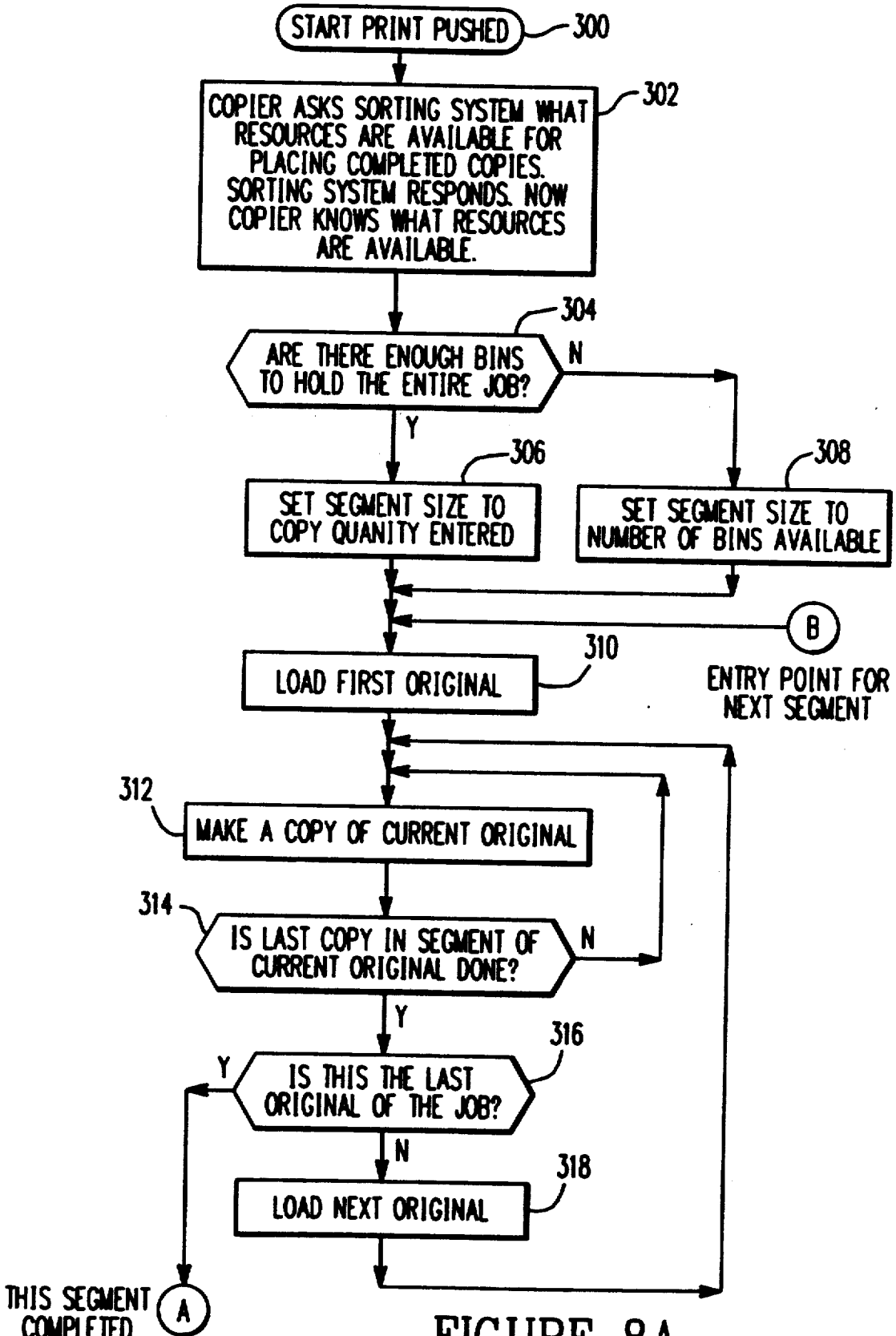
FIGS. 8A and 8B show a flow chart that represents the manner in which the duplicator is controlled in the collated simplex limitless mode to enable the copy system to produce better sorting in high-volume copy work in accordance with the present invention.

The copy system 10 operates in the collated, limitless, simplex mode when the operator enters these selections through the operator interface control 140. In accordance with the present invention, the copy system 10 is operated in this mode under the control of the control system 16 to produce output copies with efficiency and flexibility In FIGS. 8A and 8B, a flow chart specifically illustrates the operation of the copy system control 16. With the duplicator 24 and the sorter 26 started and selected to be in the collated simplex mode, the duplicator control 16 responds to a signal from the start print button as indicated by reference character 300 to execute functional block 302 which requests the sorter control 20 to send status on available resources for placing completed copies. The sorter control 20 responds and, as previously described, the status data is placed in a data base in the duplicator control 24 for use during programmed system operation.

Test block 304 then determines whether enough bins are available in empty towers to hold the entire job. If the bin count is sufficient, limitless sorting is not needed and block 306 sets the job segment size to the requested copy quantity.

If the bin count is insufficient, functional block 308 sets the job segment size to the number of bins available. Thus, all empty towers starting with a designated starting tower are used for the first pass in a limitless sorting operation.

Next, the first original is loaded in the document handler as indicated by block 310. Functional block 312 then directs the making of a copy of the current original, and the copy is delivered to its assigned sorter bin. Since the system is functioning in the simplex mode, no second side copying is required.

In test block 314, the copy count for the current original is checked to determine whether the set job segment count has been reached. If not, another copy is made by the block 312. The program continues with this cycling until the last copy is made for the job segment.

A test is then made in block 316 to determine whether the current original is the last one of the job. If not, the next original is loaded by block 318 and the described program process through blocks 312, 314 and 316 is repeated until the last original of the job has been processed.

At that time, test block 320 determines whether the last segment of the job has been completed. If not, the sorter system is shut down and test block 322 determines whether the single tower loading or the multiple tower loading option has been selected.

Generally, single tower loading employs a single-tower copy run per pass, and, in doing so, allows a quicker sorter restart and prevents subsequent shutdowns to provide a continuous run for maximum throughput as long as towers are successively emptied in time. Multiple tower loading employs a multiple-tower copy run per pass, and, in doing so, provides a longer copy run per pass and greater work time flexibility for the operator since more time is provided for unloading. In this manner, the present invention provides system operating flexibility and user efficiency since the user can choose the limitless mode most compatible and efficient for the user's job flow requirements.

Figure 8B:
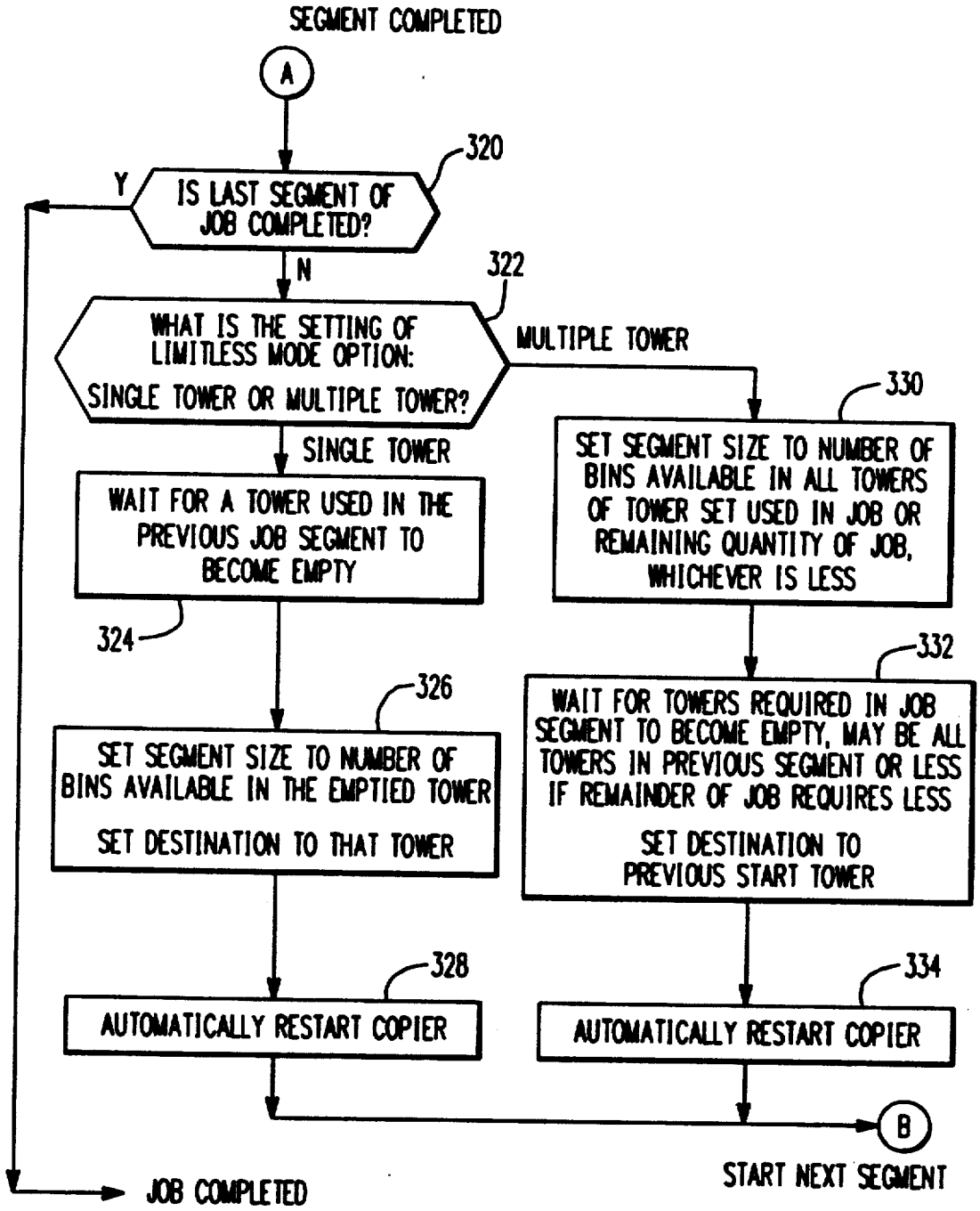
Figure 8C:
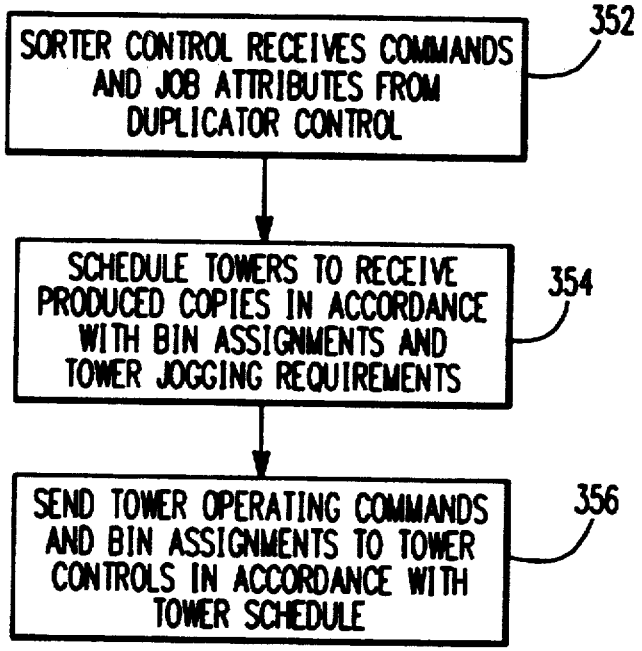
FIG. 8C shows a flow chart representing the operation of the sorter control in implementing tower and bin assignments for output copies under direction of the duplicator control.

With reference again to the flow chart in FIG. 8B, block 324 implements a wait period for the copy system 10 until a tower used in the previous job segment is emptied if a single tower loading mode selection is detected by the test block 322. When a tower becomes available, block 326 sets the size of the next segment to the number of bins available in the emptied tower and the destination for next-segment copies is set to that tower through the sorter control 20.

The duplicator and sorter are then automatically restarted by functional block 328. The program returns in the limitless mode of operation to the block 310 through the flow chart linker B and copies for the next job segment are made and distributed in the manner described for blocks 310–318. When the test block 320 detects completion of the last job segment, the job is completed as indicated.

If the test block detects a multiple tower loading selection, functional block 330 sets the size of the next job segment to the number of bins available in all towers of the tower set used in the current job or to the remaining copy quantity required for the job, whichever is less.

Block 332 then implements a wait period for the towers required for the next job segment to become empty. The required job towers may be all of the towers used in the previous segment, or fewer towers if the remainder of the copy job requires fewer towers. The destination for next-segment copies is set to the previous start tower through the sorter control 20.

The duplicator and sorter are then restarted by block 334 and copying continues in the limitless mode through the flow chart linker B as previously described. When the last job segment is determined by the block 320 to be completed, the job is completed as indicated.

The foregoing description of the preferred embodiment of the invention has been presented to illustrate the invention. It is not intended to be exhaustive or to limit the invention to the precise form disclosed, and modifications and variations are possible in light of the disclosure herein or may be developed from practice of the invention. The embodiment was chosen and described to explain the principles of the invention and its practical application and to enable one skilled in the art to use the invention in various embodiments and with various modifications as are suited to the particular use contemplated. It is intended that the scope of the invention be defined by the claims appended hereto, and their equivalents.

What is claimed is:

1. A copy system comprising:

means for duplicating successive original documents;

means for sorting output copies delivered from said duplicating means;

said sorting means including a plurality of towers each of which includes a plurality of bins;

means for transporting output copies to each of said towers;

means for directing output copies in each tower to each bin therein;

means for controlling said duplicating means and said tower transporting and bin directing means in the collated simplex mode; and said controlling means including:

means for computing the size of each segment of an entered job as a function of an entered copy quantity and as a function of available sorting means resources;

means for operating said tower transporting means and said bin directing means to deliver successive copies in a first job segment to assigned available bins in one or more towers according to the computed job segment size;

means for detecting a single tower loading or multiple tower loading selection for limitless mode operation;

means for operating said tower transporting means and said bin directing means to deliver successive copies to assigned available gins in each job segment subsequent to the first job segment in accordance with the tower loading selection detected by said detecting means;

means for shutting down said duplicating and sorting means after the completion of each job segment in the multiple tower loading mode, or after the completion of each job segment in the single tower loading mode, or after the completion of each job segment in the single tower loading mode if an empty tower is unavailable;

means for restarting said duplicating and sorting means in the single tower loading mode when an empty tower becomes available with the next segment size set to the number of bins in the empty tower and the destination of copies in the next job segment set to the empty tower;

means for restarting said duplicating and sorting means in the multiple tower loading mode when the number of towers required for the next job segment are emptied and available with the start destination of copies in the next job segment set to the next previous start tower; and means for ending the job when the last job segment is completed.

2. The copy system of claim 1 wherein said controlling means further includes means for detecting the empty status of each tower, and said restarting means includes means for directing said duplicating and sorting means to wait in each of said single tower loading and multiple tower loading modes until the required tower or towers become(s) available as indicated by said empty tower detecting means.

3. The copy system of claim 1 wherein said segment size computing means sets the next segment size in the multiple tower loading mode to the size of the next previous segment or to the remaining job quantity whichever is less.

4. The copy system of claim 1 wherein said segment size computing means sets the first segment size to the copy quantity entered if there are enough bins to hold the entered job.

5. A method for operating a copy system comprising:

operating a duplicator to copy successive original documents in the collated simplex mode;

operating a sorter having a plurality of multiple-bin towers to sort output copies delivered from the duplicator into the tower bins;

computing the size of each segment of an entered job as a function of available sorting means resources;

controlling the duplicator and towers and bins to deliver successive copies in a first job segment to assigned available bins in one or more towers according to the computed job segment size;

detecting a single tower loading or multiple tower loading selection for limitless mode operation;

operating said tower transporting means and said bin directing means to deliver successive copies to assigned available bins in each job segment subsequent to the first job segment in accordance with the tower loading selection detected by the detecting steps;

shutting down the duplicator and sorter after the completion of each job segment in the multiple tower loading mode, or after the completion of each job segment in the single tower loading mode if an empty tower is unavailable;

restarting said duplicator and said sorter when an empty tower becomes available with the next segment size set to the number of bins int he empty tower and the destination of copies in the next job segment set to the empty tower;

restarting said duplicator and said sorter when the number of towers required for the next job segment are emptied and available with the start destination of copies in the next job segment set to the next previous start tower; and ending the job when the last job segment is completed.

* * * * *